US009701379B2

(12) United States Patent
Hawkins

(10) Patent No.: US 9,701,379 B2
(45) Date of Patent: Jul. 11, 2017

(54) PROPELLER INCORPORATING A SECONDARY PROPULSION SYSTEM

(71) Applicant: Russel Ian Hawkins, Johannesburg (ZA)

(72) Inventor: Russel Ian Hawkins, Johannesburg (ZA)

( * ) Notice: Subject to any disclaimer, the term of this patent is extended or adjusted under 35 U.S.C. 154(b) by 342 days.

(21) Appl. No.: 14/419,100

(22) PCT Filed: Jul. 31, 2013

(86) PCT No.: PCT/IB2013/056281
§ 371 (c)(1),
(2) Date: Feb. 2, 2015

(87) PCT Pub. No.: WO2014/020551
PCT Pub. Date: Feb. 6, 2014

(65) Prior Publication Data

US 2015/0217845 A1 Aug. 6, 2015

(30) Foreign Application Priority Data

Jul. 31, 2012 (ZA) ..... 2012/5757

(51) Int. Cl.

| | |
|---|---|
| ***B63H 20/26*** | (2006.01) |
| ***B63H 1/20*** | (2006.01) |
| ***B63H 20/24*** | (2006.01) |
| ***B63H 1/26*** | (2006.01) |
| *B63H 1/28* | (2006.01) |

(52) U.S. Cl.
CPC ..... *B63H 1/20* (2013.01); *B63H 1/26* (2013.01); *B63H 1/28* (2013.01); *B63H 20/245* (2013.01); *B63H 20/26* (2013.01); *B63H 2001/286* (2013.01)

(58) Field of Classification Search
CPC ... B63H 1/20; B63H 1/26; B63H 1/28; B63H 20/26; B63H 20/245; B63H 2001/286
USPC ..... 416/93 A, 200 A
See application file for complete search history.

(56) References Cited

U.S. PATENT DOCUMENTS

| | | | | |
|---|---|---|---|---|
| 1,531,967 A | | 3/1925 | Macmillan | |
| 2,482,936 A | | 9/1949 | Renoux | |
| 4,212,586 A | * | 7/1980 | Aguiar | B63H 1/20 416/93 A |
| 4,802,872 A | * | 2/1989 | Stanton | B63H 1/28 416/93 A |
| 4,875,829 A | * | 10/1989 | Van der Woude | B63H 1/20 416/2 |
| 4,931,026 A | * | 6/1990 | Woodland | B63H 20/245 416/193 R |

(Continued)

FOREIGN PATENT DOCUMENTS

EP 0077931 A2 5/1983

*Primary Examiner* — Matthew W Jellett
(74) *Attorney, Agent, or Firm* — The Webb Law Firm

(57) ABSTRACT

THIS invention relates to a propeller and more particularly, but not exclusively, to a propeller for use with inboard and outboard boat engines. The propeller includes a hollow hub and a plurality of primary blades extending substantially radially outwardly from the hub, with each primary blade including a blade face, a blade back and a root section. The propeller is characterized in that a set of secondary blades are provided inside the hub, and that an inner volume of the hub is in flow communication with a volume radially outwardly of the propeller hub.

11 Claims, 4 Drawing Sheets

(56) References Cited

U.S. PATENT DOCUMENTS

| | | | | | |
|---|---|---|---|---|---|
| 5,325,662 | A * | 7/1994 | Varney | B63H 11/14 | 416/93 A |
| 5,782,607 | A | 7/1998 | Smith et al. | | |
| 5,816,869 | A * | 10/1998 | Willows | B63H 20/245 | 416/93 A |
| 5,916,003 | A * | 6/1999 | Masini | B63H 1/20 | 416/93 A |
| 6,168,485 | B1 * | 1/2001 | Hall | B63H 11/08 | 416/93 A |
| 7,056,092 | B2 * | 6/2006 | Stahl | B63H 1/14 | 416/129 |
| 7,780,419 | B1 | 8/2010 | Matheny et al. | | |
| 2004/0126242 | A1 | 7/2004 | Howard et al. | | |

* cited by examiner

PROPELLER INCORPORATING A SECONDARY PROPULSION SYSTEM

CROSS-REFERENCE TO RELATED APPLICATIONS

This application is the United States national phase of International Application No. PCT/IB2013/056281 filed Jul. 31, 2013, and claims priority to South African Patent Application No. 2012/05757 filed Jul. 31, 2012, the disclosures of which are hereby incorporated in their entirety by reference.

BACKGROUND TO THE INVENTION

THIS invention relates to a propeller and more particularly but not exclusively, to a propeller for use with inboard and outboard boat engines.

A propeller is a device that transmits power by converting rotational motion into thrust. A pressure differential is produced between forward and rear surfaces of the airfoil-shaped blade, and a fluid (such as air or water) is accelerated behind the blade, thus resulting in thrust required to drive a means of transport to which the propeller is attached. One specific type of propeller is a propeller for use as a means of propulsion in boat engines, whether outboard or inboard.

Many different propeller designs are known in the trade, and they all share some of the same design characteristics. A propeller comprises a plurality of blades extending radially outwardly from a central rotating hub. Each blade is shaped in the form of an airfoil having two opposite surfaces, being a blade face (which is the pressure side of the blade facing the stern), and the blade back (which is the suction side of the blade facing the bow). Each blade furthermore includes a leading edge, which is the edge of the propeller adjacent the forward end of the hub. The leading edge leads the blade into the flow when the propeller is providing forward thrust. The opposing edge is referred to as the trailing edge, and the radially outer zone extending between the leading edge and the trailing edge is referred to as the blade tip. The root of the blade is the fillet area in the region of transition between the blade surface and the hub periphery.

Blade surface area refers to the total surface area of the propeller blade. When a propeller rotates on a fixed axis for any period of time a centrifugal force creating a negative pressure on the blade back of each rotating blade draw water inwards, and when the oncoming blade face comes into contact with the inward flow of water the water is compressed. A positive pressure is therefore induced, and the water in this positive pressure zone then exerts a force against the adjacent body of water, resulting in thrust. Standard blade designs allow the inward flow of water to flow over the entire curvature of the blade back. This is believed to result in about 40% of the energy being wasted because on average only 60% of the negative pressure water mass is compressed by the blade face of an oncoming blade. Further energy is lost between the blade roots of each blade back, which fragments the flow of water when the positive pressure water mass collides with the negative pressure water mass. This disturbance affects the volume of water that gets displaced. It would obviously be beneficial if a way could be found to harness the wasted energy in order for the full potential energy of the water flow to be utilized.

It is accordingly an object of the invention to provide a propeller that will at least partially alleviate the above disadvantage.

It is also an object of the invention to provide a propeller having a secondary propulsion system which will aid optimizing the performance of the propeller.

SUMMARY OF THE INVENTION

According to the invention there is provided a propeller including:

a hollow hub; and a plurality of primary blades extending substantially radially outwardly from the hub, with each primary blade including a blade face, a blade back and a root section;

characterized in that a set of secondary blades are provided inside the hub, and that an inner volume of the hub is in flow communication with a volume radially outwardly of the propeller hub.

The inner volume of the hub is in flow communication with a volume between two adjacent primary blades of the propeller.

There is provided for each primary blade to have a blade face, a blade back and a blade peripheral zone comprising a leading edge, a trialing edge and a blade tip zone extending between the leading edge and the trialing edge.

Each primary blade includes a root section, which is the section of the blades where the blade merges with the hub.

There is provided for the secondary blades to be located on a hub insert which fits inside the hub, and which is secured to the hub in order to rotate with the hub.

An annular volume is formed between an inner surface of the hub and an outer surface of the hub insert, with the secondary blades disposed inside the annular volume.

The secondary blades may be of a helical blade configuration.

There is further provided for tertiary blades to extend from the hub insert, with each tertiary blade located between two adjacent secondary blades.

The tertiary blades divide the annular volume between the hub and the insert into alternating water and exhaust gas flow passages.

There is provided for the annular volume to be in flow communication with the space between two adjacent propeller blades by way of an inlet opening.

More specifically, there is provided for each water flow passage in the annular volume to be in flow communication with the space between two adjacent propeller blades by way of an inlet opening.

The inlet opening is preferably located adjacent a root of a blade on the blade face side of the blade.

There is provided for the inlet opening to extend along substantially the entire root of the blade.

There is also provided for a guide vane for guiding flow into the inlet opening to be located adjacent the inlet opening.

There is provided for the exhaust gas flow passage in use to be in flow communication with an exhaust gas outlet of an engine to which the propeller is secured.

The hub insert may be releasably securable to hub.

The hub insert may have a first end which is securable to the front end of the hub, and a second end protruding beyond the second, rear end of the hub.

There is provided for the second end of the hub insert to form an expansion nozzle of reduced area in order in use to provide a high velocity water outlet jet, and accordingly thrust, when water is expelled therethrough.

BRIEF DESCRIPTION OF THE DRAWINGS

A preferred embodiment of the invention is described by way of a non-limiting example, and with reference to the accompanying drawings in which.

DETAILED DESCRIPTION OF INVENTION

Figure 1:
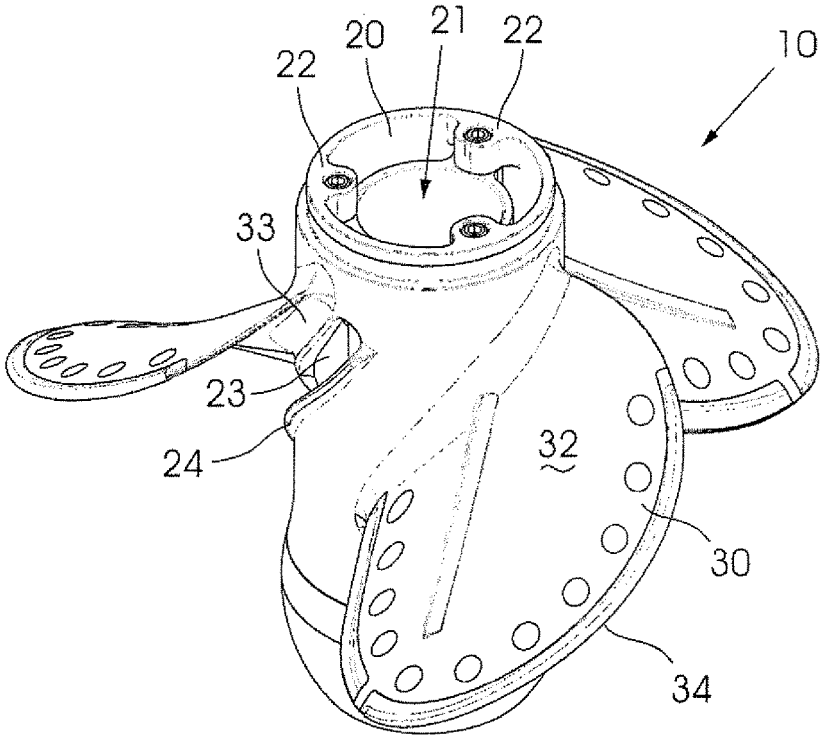
FIG. 1 is a front perspective view of the propeller incorporating a secondary propulsion system in accordance with one embodiment of the invention.
Figure 2:
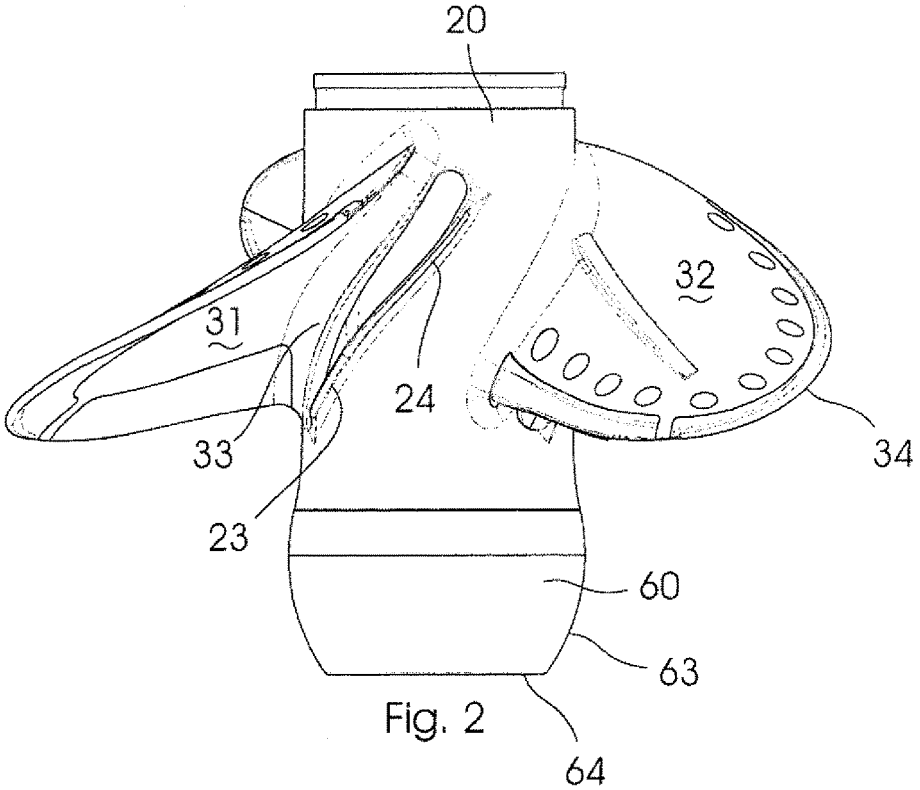
FIG. 2 is a side view of the propeller of FIG. 2.
Figure 3:
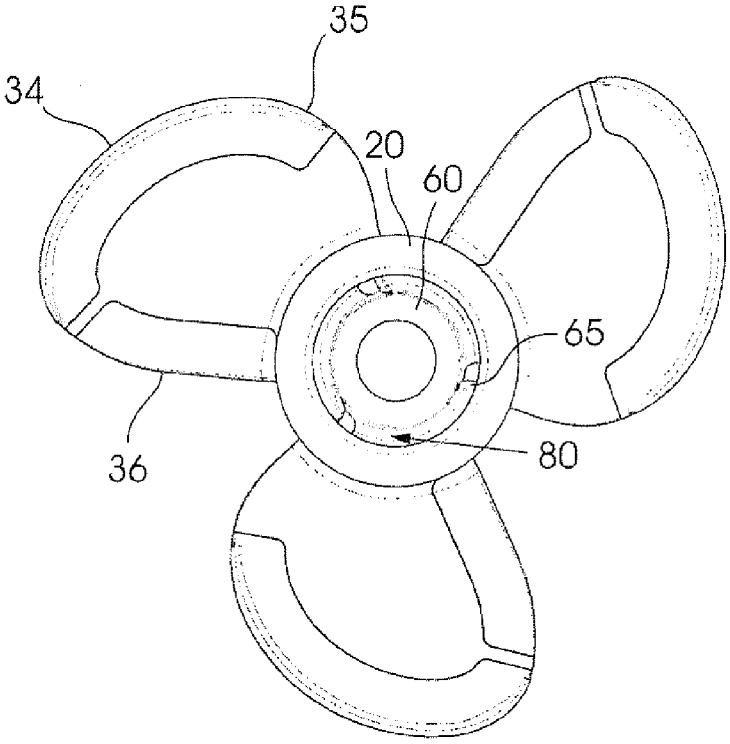
FIG. 3 is bottom plan view of the propeller of FIG. 1.
Figure 4:
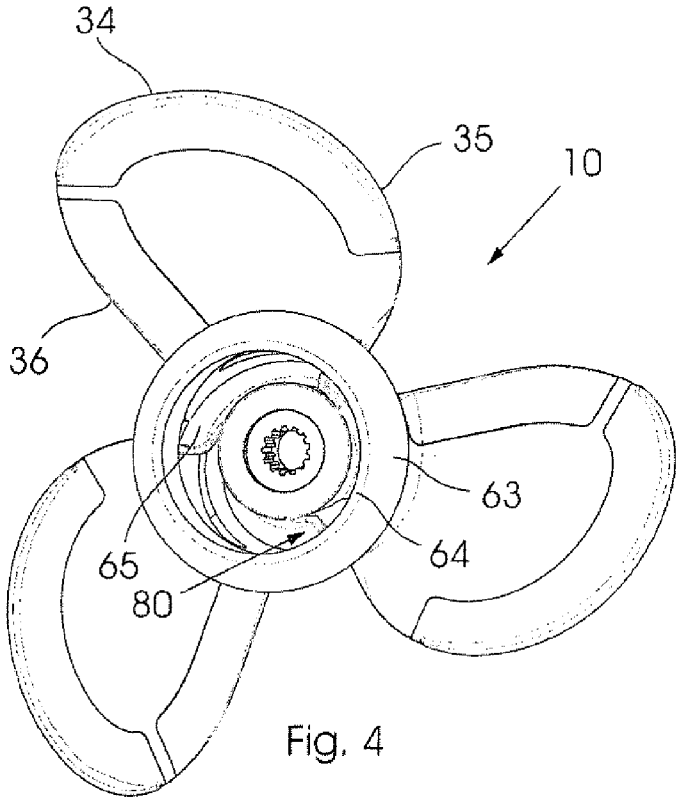
FIG. 4 is a bottom perspective view of the propeller of FIG. 1.

Referring to the drawings, in which like numerals indicate like features, a non-limiting example of propeller in accordance with the invention is generally indicated by reference numeral 10.

The propeller 10 comprises a hub 20, which may be of many different configurations. In one embodiment the propeller includes a flow guide as described in the applicant's co-pending application entitled "Propeller including a blade back flow guide", the contents of which is incorporated herein by reference. In one embodiment the propeller also includes the provision of edge members on the blades of the propeller entitled "Propeller including a discrete edge member", the contents of which is also incorporated herein by reference.

A plurality of primary blades 30 extend radially outwardly from the hub 20, with each blade defining an airfoil extending from the hub 20 at a root section 33 thereof, and terminating in a peripheral tip zone 34. The blade 30 includes a blade face 31 and a blade back 32. The periphery of the blade 30 comprises a leading edge 35, a trailing edge 36, and an outer tip zone 34 extending between the leading edge 35 and the trailing edge 36.

The hub 20 of the propeller has a hollow interior 21, and includes receiving formations for receiving and securing a hub insert 60 as is described in more detail below. A hub inlet opening 23 is provided in a sidewall of the hub 20, and provides flow communication between the hollow interior 21 of the hub 20, and a space between adjacent blades 30 of the propeller. More particularly, the inlet opening 23 is of an elongate configuration, and is located adjacent a root 33 of a blade 30, on the blade face side 31 of the blade 30. The inlet opening 23 extends along substantially the entire root 33 of the blade 30. An inlet guide vane 24 may be located adjacent the inlet opening 23 on the side of the opening opposite the blade 30, and aids in directing water into the inlet opening 23, and thus into the interior volume 21 of the hub.

The hub insert 60 is in the form of a tubular body having a front end 61 and a rear end 63. The hub insert 60 fits inside the hub 20, with the rear end 63 of the hub insert 60 protruding from the hub 20. The front end 61 of the hub insert 60 is secured to the hub 20 by way of securing means that engages the receiving formations 22 provided on the hub 20. It should be noted that the manner in which the hub insert 60 is secured to the hub 20 may vary, and that the way in which the hub insert 60 is secured to the hub 20 is therefore not of a limiting nature. Various ways of securing the hub insert 60 to the hub 20 can easily be conceived by a person skilled in the art.

The hub insert 60 is centrally located inside the hub 20, and an annular volume 80 is therefore formed between the inner surface of the hub 20 and the outer surface of the hub insert 60.

Figure 5:
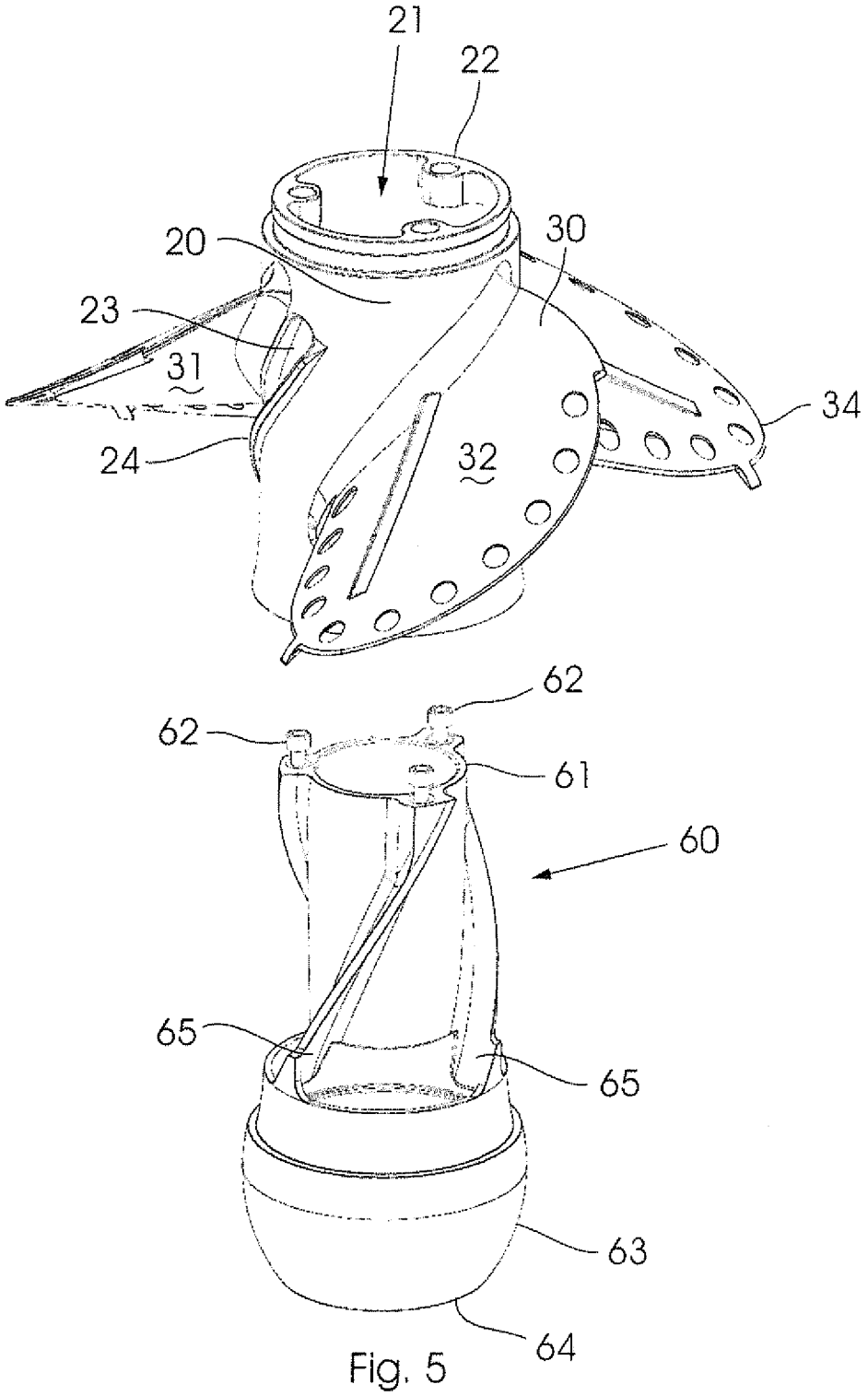
FIG. 5 is an exploded perspective view of the propeller of FIG. 1.

In the embodiment of FIG. 5, secondary blades 65 extend from the hub insert 60, and are disposed inside the annular volume in order to displace water that enters the annular volume through the inlet opening 23 of the hub 20. In this example the blades are in the form of helical blades that extend substantially to the rear end 63 of the hub insert 60. The rear end 63 of the hub insert terminates in an outlet nozzle 64, which is of a smaller diameter than the rest of the hub insert 60. This causes the water displaced by the blades 65 to be accelerated, and hence in an increase in thrust. However, the inventor has found that the performance of this arrangement is not optimal, due to the fact that the annular volume is also the conduit through which exhaust gasses are discharged from an engine to which the propeller is secured. The high-pressure exhaust gasses interferes with the intake of water through the inlet openings 23, and an improvement of the design (although not an absolute limitation) is shown in FIG. 6.

Figure 6:
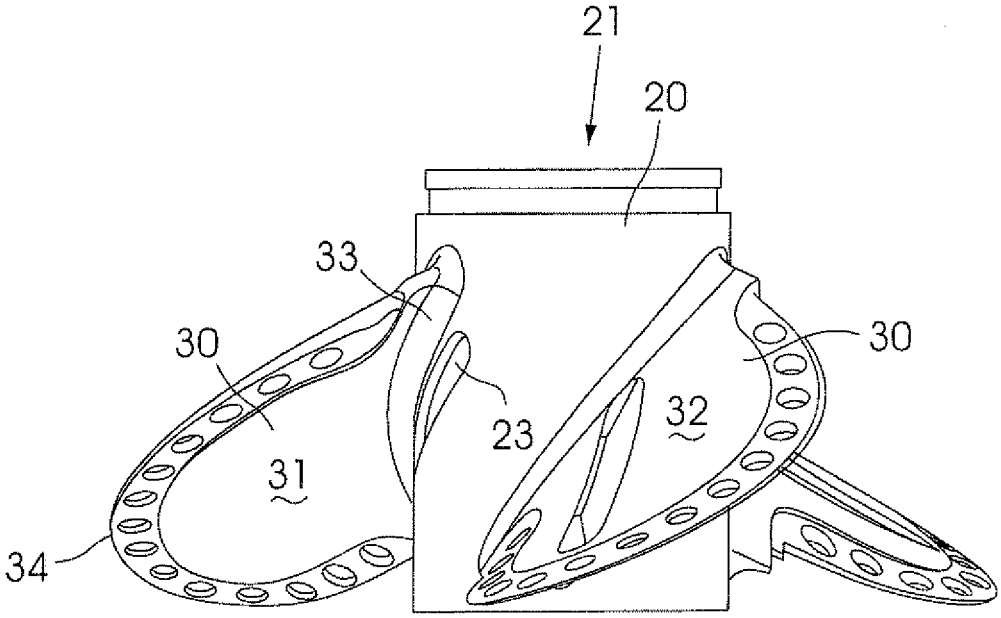
FIG. 6 is an exploded perspective view of another embodiment of the propeller.
Figure 6:
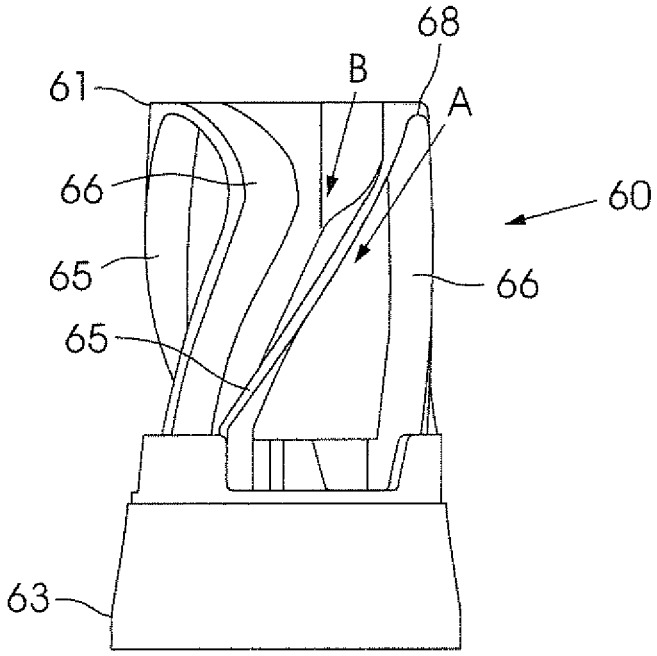

In the embodiment of FIG. 6, secondary blades 65 also extend from the hub insert 60, and are disposed inside the annular volume in order to displace water that enters the annular volume through the inlet opening 23 of the hub 20. In this example the blades are in the form of helical blades that extend substantially to the rear end 63 of the hub insert 60. The rear end 63 of the hub insert terminates in an outlet nozzle 64, which is of a smaller diameter than the rest of the hub insert 60. This causes the water displaced by the blades 65 to be accelerated, and hence in an increase in thrust. Tertiary blades 66 are provided in addition to the secondary blades 65, and are disposed between adjacent secondary blades 65. The configuration of secondary blades 65 and tertiary blades 66 define a plurality of distinct and alternating water (A) and exhaust gas (B) passages. The passages are isolated from one another, and exhaust gas will not enter the water passages and vice versa. The water passages (A) are in flow communication with the hub openings 23, whereas the exhaust gas passages (B) are not. In use, exhaust gasses will enter the exhaust gas passages (B) from an open end of the passages at the front end 61 of the hub insert, and will leave the passages at a rear end 63 of the hub insert. Water will enter the water passages (A) via the hub openings 23, and will exit the water passages (A) at a rear end 63 of the hub insert. It should be noted that an operatively forward end of a water passage 68 is a closed end, because the water enters the passage in a radial direction, as opposed to the axial inlet direction of the exhaust gas passage (B).

Eddie stabilizers may be provided to stabilize the vortex of water being created by the intake of water through the intake openings and pushes out a unidirectional jet of water.

In use, the propeller creates secondary propulsion by water being drawn into the annulus between the hub and the hub insert via the inlet openings, with the water then being accelerated by the secondary blades, and forced through the reduced area throat of an outlet nozzle. Due to the provision of tertiary blades, this happens in isolation to the flow of exhaust gasses through the same annulus.

The secondary blade design and efficiency is intricately linked to the design of other components that make up the secondary propulsion i.e., the intake openings, the volumetric area, the laminar transition of the intake openings, the positioning and configuration of eddy stabilisers' positioning (including angle of trajectory), venturi rate of compression, venturi "bowl" area and the outlet nozzle.

The design of the intake openings is of particular importance and there are a multitude of factors that determine its length and size. For instance, a larger hub and greater blade displacement will influence the intake opening design with a widening of the intake gradually and altering the degree of angle of each secondary blade. This maximizes the amount of water available for acceleration. It has been found that an intake opening extending substantially the entire length of the root of a blade will result in superior performance. There is also provided for the width of the intake opening to be approximately between 10% and 35% of the distance between two adjacent blade roots. Preferably the width of the intake will be between 15 and 25% of the distance between two adjacent blade roots.

The propeller, and in particular the hub insert of the propeller, will be secured to a drive shaft of an engine by way of a spline, which is a methodology and configuration which is well known in the art.

The propeller 10 body is made from magnesium or a magnesium alloy, which is made in a moulding process known in the art. The inlet guide vanes 24 are integrally formed with the propeller blades and body. In addition, the inlet openings 23 are also formed a part of the moulding process, and are in particular not machined afterwards.

It will be appreciated that the above is only one embodiment of the invention and that there may be many variations without departing from the spirit and/or the scope of the invention.

The invention claimed is:

1. A propeller including:

a hub which is hollow;

a plurality of primary blades extending substantially radially outwardly from the hub, with each primary blade including a blade face, a blade back and a root section;

wherein an inner volume of the hub is in flow communication with a volume radially outwardly of the hub;

a set of secondary blades located on a hub insert which fits inside the hub, wherein an annular volume is formed between an inner surface of the hub and an outer surface of the hub insert, with the secondary blades disposed inside the annular volume; and tertiary blades which extend from the hub insert, with each tertiary blade located between two adjacent secondary blades in order for the secondary blades and the tertiary blades to divide the annular volume between the hub and the insert into alternating water and exhaust gas flow passages.

2. The propeller of claim 1, wherein the annular volume is in flow communication with the space between two adjacent propeller blades by way of an inlet opening.

3. The propeller of claim 2, wherein the inlet opening is located adjacent a root of a blade on the blade face side of the blade.

4. The propeller of claim 3, wherein a guide vane for guiding flow into the inlet opening is located adjacent the inlet opening.

5. The propeller of claim 1, wherein the secondary blades are of a helical blade configuration.

6. The propeller of claim 1, wherein each water flow passage in the annular volume is in flow communication with a space between two adjacent propeller blades by way of an inlet opening.

7. The propeller of claim 6, wherein the exhaust gas flow passage is in flow communication with an exhaust gas outlet of an engine to which the propeller is secured.

8. The propeller of claim 1, wherein the hub insert has a first end which is securable to a front end of the hub, and a second end protruding beyond a rear end of the hub.

9. The propeller of claim 8, wherein the second end of the hub insert forms an expansion nozzle of reduced area in order in use to provide a high velocity water outlet jet, and accordingly thrust, when water is expelled therethrough.

10. The propeller of claim 6, wherein the inlet opening is located adjacent a root of a blade on the blade face side of the blade.

11. The propeller of claim 10, wherein a guide vane for guiding flow into the inlet opening is located adjacent the inlet opening.

* * * * *